US005611702A

United States Patent [19]

Okamoto et al.

[11] Patent Number: 5,611,702

[45] Date of Patent: Mar. 18, 1997

[54] LEVER CONNECTOR

[75] Inventors: Kenichi Okamoto; Naoto Taguchi, both of Shizuoka, Japan

[73] Assignee: Yazaki Corporation, Tokyo, Japan

[21] Appl. No.: 365,370

[22] Filed: Dec. 28, 1994

[30] Foreign Application Priority Data

Dec. 28, 1993 [JP] Japan ..... 5-350672

[51] Int. Cl.[6] ..... H01R 13/62

[52] U.S. Cl. ..... 439/157

[58] Field of Search ..... 439/157, 372

[56] References Cited

U.S. PATENT DOCUMENTS

| | | | |
|---|---|---|---|
| 5,135,410 | 8/1992 | Kawase et al. | 439/157 |
| 5,172,998 | 12/1992 | Hatagishi | 439/157 |
| 5,252,084 | 10/1993 | Wakata | 439/157 |

FOREIGN PATENT DOCUMENTS

| | | | |
|---|---|---|---|
| 5251134 | 9/1993 | Japan | H01R 13/629 |

*Primary Examiner*—David L. Pirlot
*Assistant Examiner*—Eugene Byrd
*Attorney, Agent, or Firm*—Sughrue, Mion, Zinn, Macpeak & Seas

[57] ABSTRACT

A female connector and a male connector engageable with each other are paired. Fixing shafts are projected from both lateral sides of the male connector. The female connector has a retaining lever being pivotable about pivots arranged on both lateral sides thereof. Rail portions are arranged on a front surface of the lever, each rail portion having a predetermined surface of curvature. When the male connector is inserted into the female connector, shaft portions of the fixing shafts are abutted against the rail portions and bias the rail portions, so that the surfaces of curvature produce resisting forces, each having a component for pivoting they lever.

2 Claims, 5 Drawing Sheets

LEVER CONNECTOR

BACKGROUND OF THE INVENTION

1. Field of the invention

The invention relates to a lever connector requiring only small inserting and pulling force, which is adapted for use chiefly in mutually connecting wire harnesses for automobiles.

2. Related art

A conventionally known connector of this type is shown in FIGS. 8 and 9. This connector using a spring is disclosed in Japanese Unexamined Patent Publication Hei. 4-87169.

In the process of bringing an intermediately inserted condition of male and female connectors 101, 102 in FIG. 8 into a completely inserted condition thereof in FIG. 9, a lock projection 104 of a cam lever 103 that is pivotably arranged on the connector 102 first pushes a lock portion 108 down with a tapered engagement portion 105 of the lock projection 104 sliding over a tapered engagement portion 109 of the lock portion 108 in a lock arm 107 on the connector 101 side, and then reaches the bottom of the lock portion 108 while passing over the lock portion 108 upon complete insertion. As a result, both connectors are regularly retained as shown in FIG. 9.

If the cam lever 103 is in the lowered condition while both connectors 101, 102 are being engaged, movement of the connector 101 in a movement direction is blocked, thus not allowing the connector 101 to be further inserted.

To overcome this problem, the operator has to first manually return the cam lever 103 to the elevated initial position at the time of starting the engagement of both connectors 101, 102, and then insert the connector 101 into the connector 102 for temporary engagement, which is a cumbersome operation.

Therefore, to dispense with this cumbersome operation, the conventional lever connector is so designed that a coil spring 106 is additionally provided at the shaft portion of the cam lever 103 arranged on the connector 102 so that the cam lever 103 is urged to be erected at the initial position.

As described above, in the conventional art, the initial position of a retaining lever (the cam lever 103 in the aforementioned example) is strictly limited in the process of assembling the connector.

To permit easy operation, a mechanism such as a spring (the coil spring 106 in the aforementioned example) must be arranged to set the retaining lever to the limited initial position, which has made it difficult to achieve an inexpensive connector.

SUMMARY OF THE INVENTION

The invention has been made to overcome the aforementioned problems and shortcomings. Accordingly, the object of the invention is to provide a lever connector that can achieve reliable insertion and retainment with a simple operation at a low cost irrespective of the initial position of the retaining lever in the process of assembling the connector.

To achieve the above object, the invention is applied to a lever connector comprising a pair of connectors engageable with each other, one of the connectors having fixing shafts on both lateral sides thereof so as to be projected, and the other connector having a retaining lever being pivotable about pivots arranged on both lateral sides thereof. Rail portions are arranged on a front end of the retaining lever, each rail portion having a surface of curvature. In such a lever connector, when the connector having the fixing shafts is inserted into the other connector having the retaining lever, shaft portions of the fixing shafts are abutted against the rail portions and bias the rail portions to thereby produce resisting forces, and each surface of curvature is designed so that each resisting force has a component for pivoting the retaining lever.

In the lever connector of the invention, engagement grooves are formed in both lateral sides of the other connector, the engagement grooves allowing the fixing shafts to be inserted thereinto; the retaining lever has retaining grooves so as to extend inward; and pivoting of the lever is stopped upon coincidence of the engagement grooves with the retaining grooves.

When the connector having the fixing shafts is inserted into the connector having the lever, the shaft portions of the fixing shafts bias the rail portions while abutted against the rail portions. Resisting forces are produced at the abutted portions by the biasing, and a component of each resisting force for pivoting the lever causes the lever to pivot about the pivots of the lever.

Since the surface of curvature of each rail portion of the lever is designed so that the produced resisting force has a component for pivoting the lever no matter where the lever is positioned, the operation of engaging both connectors can be started at an arbitrary initial position without having the lever set to a predetermined initial position.

DETAILED DESCRIPTION OF THE PREFERRED EMBODIMENTS

An embodiment of the invention will now be descried with reference to FIGS. 1 to 7 out of the accompanying drawings.

Figure 1:
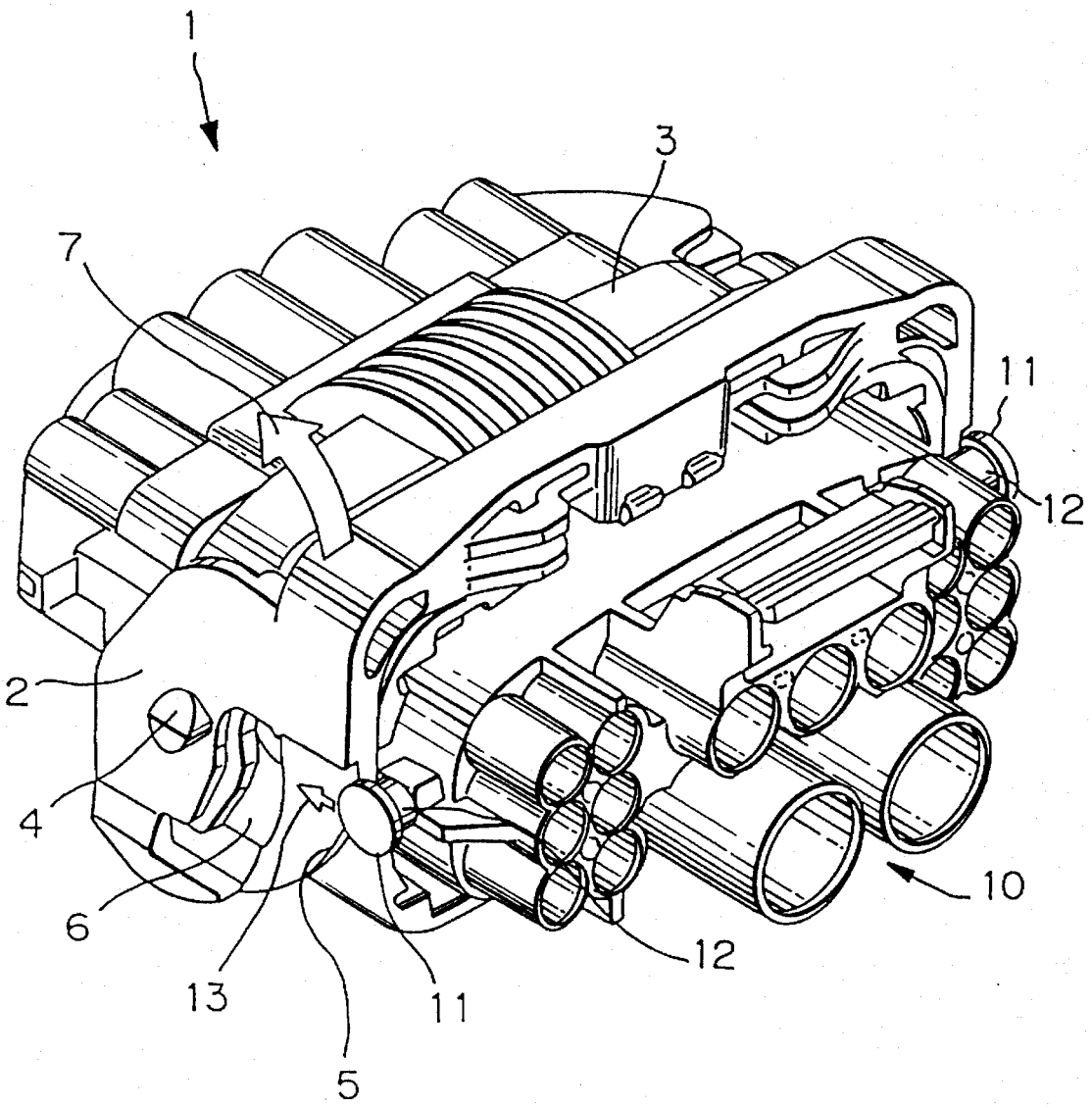
FIG. 1 is a perspective view of a lever connector, which is an embodiment of the invention.

FIG. 1 is a perspective view showing a lever connector, which is the embodiment of the invention.

In FIG. 1 a lever connector 1 is composed of a pair of female connector 3 and a male connector 10 that are engageable with each other. FIG. 1 shows a condition in which insertion of the male connector 10 into the female connector 3 is started with the male connector 10 being advanced in a direction indicated by an arrow, which is a fixing shaft moving direction.

The male connector 10 has on both lateral sides thereof fixing shafts 11 formed so as to be projected outwardly, each fixing shaft having a recessed shaft portion 12 formed thereon. The female connector 3 has a retaining lever 2 that is pivotable about pivots 4 arranged on both lateral sides thereof.

In the front surface of the retaining lever 2 are rail portions 5, each of which has a predetermined surface of curvature, and in both lateral sides thereof are retaining grooves 6, which extend inward.

At the time the male connector 10 is inserted into the female connector 3, the shaft portion 12 of each fixing shaft 11 of the male connector 10 is abutted against the corresponding rail portion 5 and biases such rail portion 5. The biasing forces produce resisting forces at the abutted portions, respectively. Each surface of curvature is designed so that the resisting force has a component for pivoting the lever 2.

In addition, no matter which position of the rail portion the shaft portion 12 is abutted against and biases, each surface of curvature is designed so that the resisting force produced at that portion has a component for pivoting the lever 2 at all times.

For example, the front surface of each rail portion 5 is formed of a projected surface of curvature, or at least the front surface of each rail portion 5 corresponding to the entire lever 2 pivoting range is formed of a projected surface of curvature.

As a result of forming each rail portion 5 of either one of the aforementioned projected surfaces of curvature, a resisting force "b" produced at an abutted portion has a component "c" that is perpendicular to a line segment connecting the pivot 4 and the abutted portion and that is directed upward (see FIG. 4) no matter which position of the rail portion 5 the shaft portion 12 is abutted against and biases.

Figure 4:
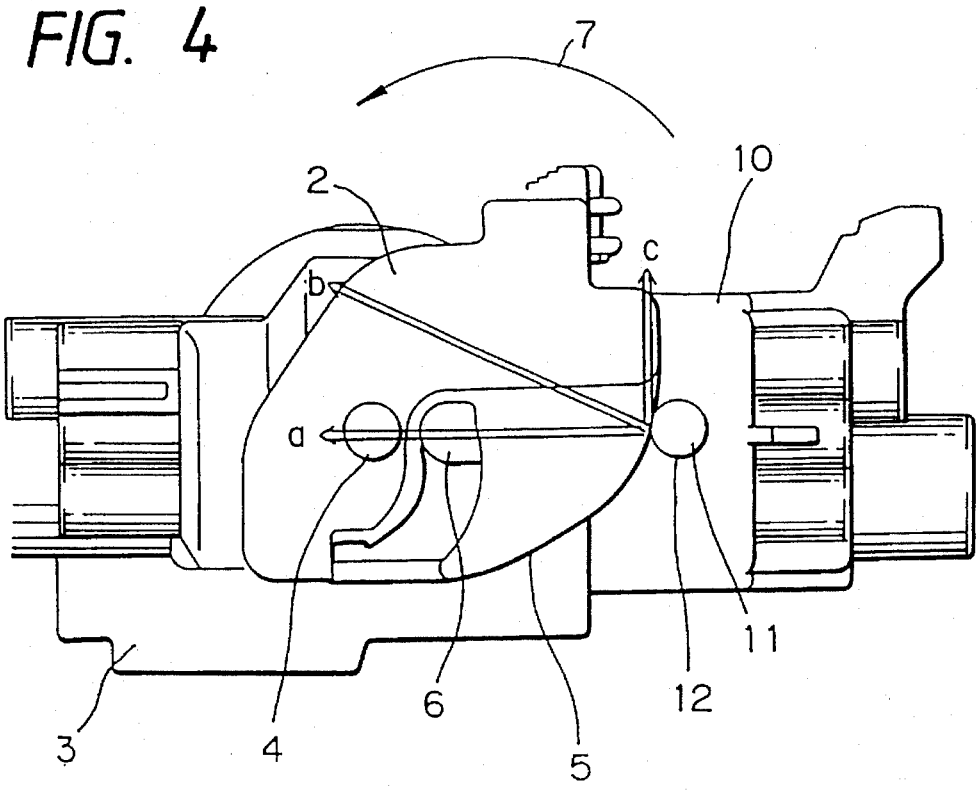
FIG. 4 is a front view showing a process in which the lever connector of FIG. 1 is being inserted.

This resisting force component "c" causes the lever 2 to pivot about the pivots 4 in a lever pivoting direction 7 shown in FIG. 4. Therefore, since the resisting force component "c" is produced by the biasing of each shaft portion 12 onto the corresponding rail portion 5 no matter which position of the rail portion 5 the shaft portion 12 is abutted against, a force for pivoting the lever 2 is applied to the lever 2 as long as the shaft portion 12 is abutted against the rail portion 5 and biases the rail portion 5. Hence, the lever 2 can continue pivoting smoothly.

Figure 2:
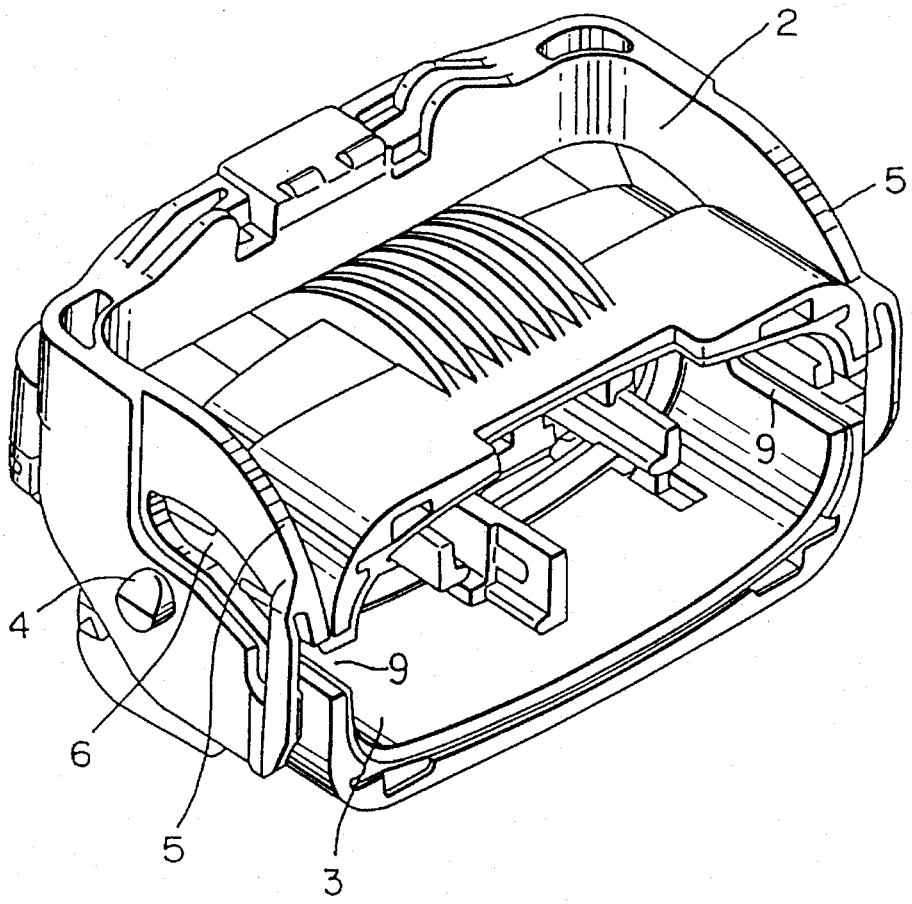
FIG. 2 is a perspective view of a female connector of FIG. 1.
Figure 3:
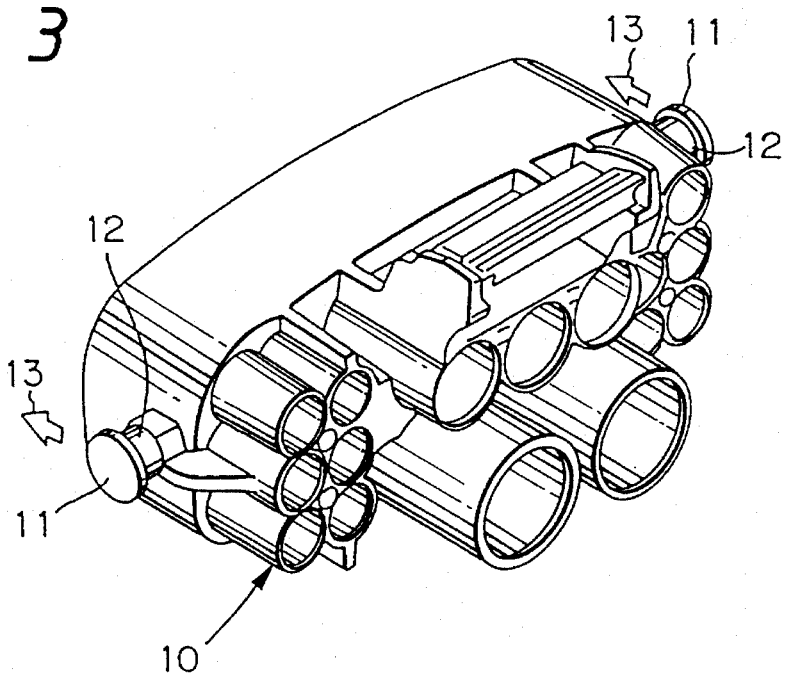
FIG. 3 is a perspective view of a male connector of FIG. 1.

FIGS. 2 and 3 are perspective views showing the female connector 3 and the male connector 10 constituting the lever connector shown in FIG. 1, respectively. FIG. 2 shows the lever 2 being pivoted completely upward. This lever condition is merely an example; the operation of engaging both connectors 3, 10 can be performed smoothly no matter where the lever 2 is positioned.

It should be noted that the retaining lever 2 is designed so that the end portions of the rail portion 5, which correspond to the front surface of the connector in such a condition as shown in FIG. 2, are expanded outward, and that the female connector 3 has engagement grooves 9 on both lateral sides thereof so that the fixing shafts 11 of the male connector 10 can be inserted into the engagement grooves 9 after passing through the rail portions 5 at the time the male connector 10 is inserted into the female connector 3.

That is, the female connector 3 shown in FIG. 2 is in a condition in which the engagement grooves 9 and the retaining grooves 6 of the lever 2 are coincident with each other.

A mode of operation of the lever connector of the invention will be described next with reference to FIGS. 4 to 7, which are front views showing a series of processes of engaging the lever connector of FIG. 1.

FIG. 4 is a front view corresponding to FIG. 1 and shows a condition in which the operation of inserting the male connector 10 into the female connector 3 is started.

As shown in FIG. 4, the lever 2 arranged on the female connector 3 is fallen down completely, which is an exemplary condition. Here, the shaft portion 12 of the fixing shaft 11 disposed on each lateral side of the male connector 10 is abutted against the corresponding rail portion 5 having a predetermined surface of curvature.

As the male connector 10 is further pushed in, a force "a" acting on the abutted portion in the fixing shaft moving direction is applied to the lever 2, which causes the perpendicular resisting force "b" in the normal direction of the tangential plane to be generated with respect to the lever 2 as shown by the arrow "b" in FIG. 4. The component "c" of the perpendicular resisting force "b" which extends in the direction at right angles to the line connecting the point of contact and the pivot 4 acts to pivot the lever 2 in the pivoting direction 7.

Figure 5:
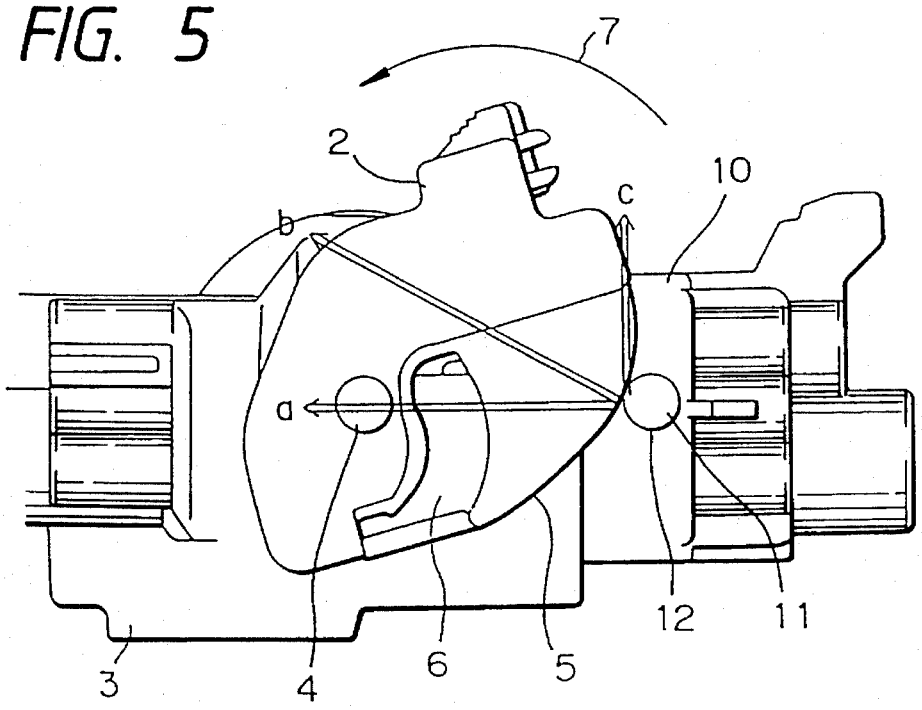
FIG. 5 is a front view showing a process in which the lever connector of FIG. 1 is being engaged.

As a result, the lever 2 pivots in the pivoting direction 7 to some degree as shown in FIG. 5. In association with this pivoting of the lever 2, each shaft portion 12 continuously imparts the resisting force "b" while sliding over the curved surface of the corresponding rail portion, thereby causing the lever 2 to continue pivoting.

Figure 6:
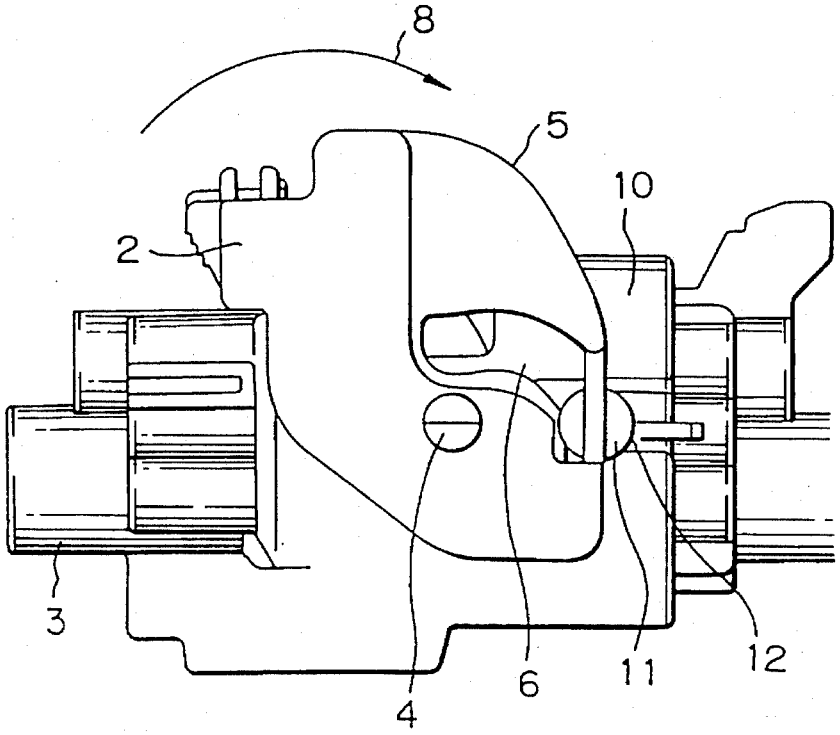
FIG. 6 is a front view showing the lever connector of FIG. 1 in the temporarily engaged condition.

As the male connector 10 is further inserted and the lever 2 is thereby caused to continues pivoting, the male connector 10 soon comes to be inserted into the predetermined position with the lever 2 being pushed up, so that the lever connector is brought into the temporarily engaged condition such as shown in FIG. 6.

Under this temporarily engaged condition, each fixing shaft 11 and shaft portion 12 are positioned along the corresponding retaining groove 6 of the lever 2. To bring this temporarily engaged condition into a regularly engaged condition, i.e., a regularly retained condition, the lever 2 is manually pivoted in a direction opposite to the pivoting direction, i.e., in a rotating direction 8 in FIG. 6.

Figure 7:
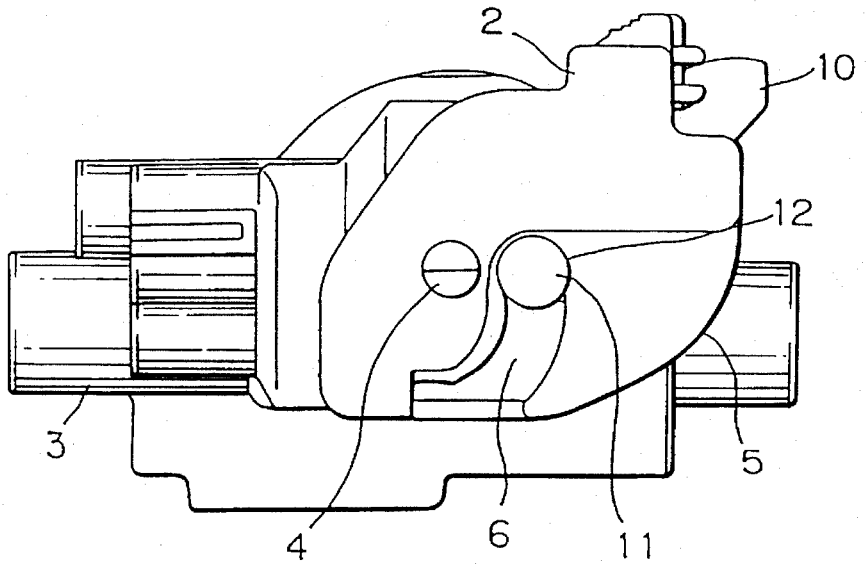
FIG. 7 is a front view showing the lever connector of FIG. 1 in the completely engaged condition.
Figure 8:
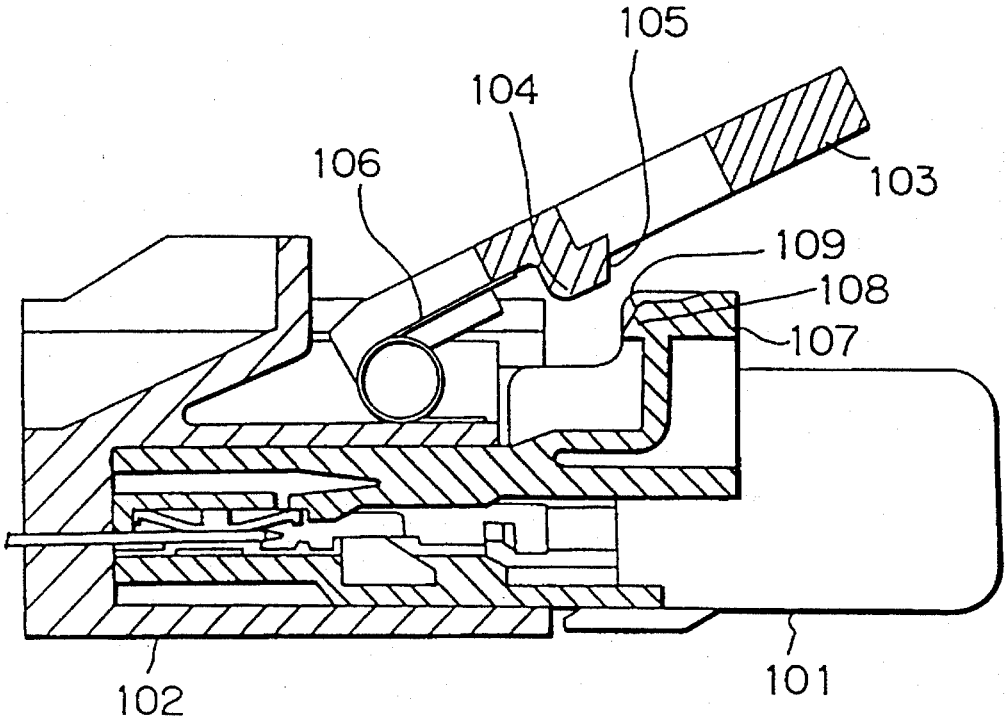
FIG. 8 is a front sectional view of a conventional spring lever connector before engagement.
Figure 9:
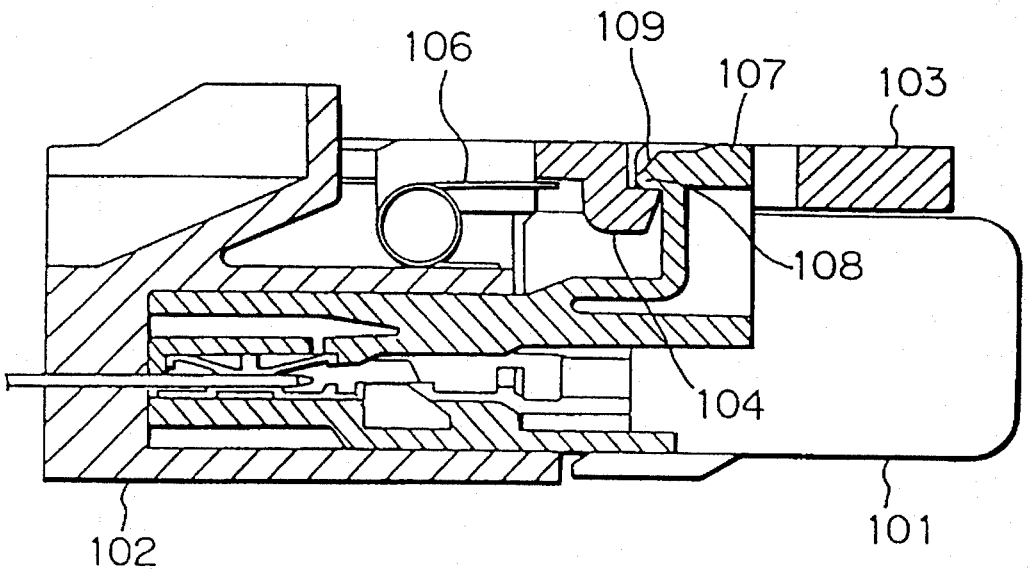
FIG. 9 is a front sectional view of the conventional spring lever connector after engagement.

As a result of the manually pivoting operation, the lever 2 pivots while allowing the shaft portion 12 to slide over the inner wall of the retaining groove 6 thereof because the shaft portion 12 is positioned along the retaining groove 6 of the lever 2, and soon falls down completely with the bottommost portion of the retaining groove 6 thereof gripping the shaft portion 12 as shown in FIG. 7. Hence, both connectors 3, 10 are retained.

As is apparent from the foregoing, even if the operation of inserting the male connector 10 into the female connector 3 is started with the lever 2 being not at the position shown in FIG. 4, but at, e.g., the slightly upwardly pivoted position shown in FIG. 5, both connectors can be temporarily engaged as shown in FIG. 6 without any difficulty. That is, according to the construction of the invention, the operation of engaging the connectors can be started without being restricted by the initial position of the lever 2, i.e., with the lever 2 being at an arbitrary position.

This advantage not only improves operability significantly but also eliminates such a member as a spring for holding the lever 2 at a predetermined position in the initial condition, thereby allowing the cost of manufacture of the connector to be reduced and in turn contributing to achieving reduction in breakdown due to reduction in the number of parts involved. These industrial advantages are not small.

While the aforementioned embodiment is characterized by a combination of the retaining lever with the female connector and a combination of fixing shaft with the male connector, such combinations may, of course, be reversed.

As described in the foregoing, in the lever connector of the invention, a retaining lever is arranged so as to be pivotable about pivots on one of a pair of connectors; shaft portions of fixing shafts arranged on the other connector are caused to be abutted against rail portions of the lever and bias such rail portions, each rail portion having a surface of curvature; and a resisting force produced at each abutted portion as a result of the biasing has a component for pivoting the lever. In addition, each resisting force produced has a component for pivoting the lever at all times no matter where the lever is positioned within the pivoting range thereof. Therefore, the invention can provide an advantage that insertion and retainment of the connectors can be implemented smoothly with the lever being at any initial position.

This advantage brings about additional advantages such as a remarkable improvement in operability at the time of assembling the connector and a significant reduction in the cost of manufacture by dispensing with a spring that has been requisite for holding the lever in a predetermined place in the conventional construction.

What is claimed is:

1. A lever connector assembly comprising:

a first connector having a retaining lever being pivotable about pivots arranged on both lateral sides thereof, rail portions being arranged on a front surface of the retaining lever, each rail portion having a surface of curvature; and a second connector having fixing shafts on both lateral sides thereof so as to be projected in an outward lateral direction, wherein said fixing shafts have recessed shaft portions for abutting said rail portions and pivoting said retaining lever;

wherein when the second connector is inserted into the first connector having the retaining lever, said recessed shaft portions of the fixing shafts are abutted against and bias the rial portions to provide resisting forces, and each surface of curvature is designed so that the resisting forces pivot the retaining lever at all positions of the retaining lever relative to the recessed shaft portions.

2. A lever connector as claimed in claim 1, further comprising engagement grooves formed in both lateral sides of the second connector for allowing the fixing shafts to be inserted thereinto, wherein the retaining lever has retaining grooves for receiving the fixing shaft, and pivoting of the retaining lever caused by the resisting forces is stopped upon coincidence of the engagement grooves with the retaining grooves.

* * * * *